US011280306B1

(12) United States Patent
Bannur Nagaraja et al.

(10) Patent No.: US 11,280,306 B1
(45) Date of Patent: Mar. 22, 2022

(54) FUEL INJECTOR HAVING DRY-RUNNING PROTECTION VALVE AND FUEL SYSTEM USING SAME

(71) Applicant: Caterpillar Inc., Peoria, IL (US)

(72) Inventors: Manjunath Bannur Nagaraja, Naperville, IL (US); Venkata R. Tatikonda, Peoria, IL (US); Benjamin R. Tower, Varna, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/150,159

(22) Filed: Jan. 15, 2021

(51) Int. Cl.

| | |
|---|---|
| ***F02M 63/00*** | (2006.01) |
| ***F02M 61/18*** | (2006.01) |
| ***F02F 1/24*** | (2006.01) |
| ***F02M 61/14*** | (2006.01) |
| ***F02M 61/20*** | (2006.01) |

(52) U.S. Cl.
CPC ..... *F02M 63/0054* (2013.01); *F02F 1/242* (2013.01); *F02M 61/14* (2013.01); *F02M 61/1806* (2013.01); *F02M 61/20* (2013.01)

(58) Field of Classification Search
CPC ..... F02M 63/0054; F02M 61/14; F02M 61/1802; F02M 61/20; F02F 1/242
USPC ..... 123/470
See application file for complete search history.

(56) References Cited

U.S. PATENT DOCUMENTS

| | | | | |
|---|---|---|---|---|
| 1,329,559 | A | 2/1920 | Tesla | |
| 2,590,575 | A * | 3/1952 | Rogers | F02M 59/265 417/307 |
| 4,213,434 | A * | 7/1980 | Vogtmann | F02M 55/002 123/364 |
| 4,373,476 | A * | 2/1983 | Vervoordt | F01L 7/06 123/190.14 |
| 4,440,135 | A * | 4/1984 | Asami | F02M 61/205 123/446 |
| 4,628,881 | A | 12/1986 | Beck et al. | |
| 4,948,049 | A | 8/1990 | Brisbon et al. | |
| 5,235,954 | A * | 8/1993 | Sverdlin | F02D 7/00 123/447 |
| 5,463,996 | A | 11/1995 | Maley et al. | |
| 5,638,791 | A | 6/1997 | Tsuzuki et al. | |
| 5,738,284 | A * | 4/1998 | Gruendl et al. | F02M 51/00 |
| 6,029,902 | A * | 2/2000 | Hickey | F02M 57/021 239/127 |
| 6,622,701 | B2 | 9/2003 | Endo | |

(Continued)

FOREIGN PATENT DOCUMENTS

| | | |
|---|---|---|
| EP | 1757799 A1 | 2/2007 |
| EP | 3112700 B1 | 3/2018 |

(Continued)

*Primary Examiner* — Mahmoud Gimie
(74) *Attorney, Agent, or Firm* — Brannon Sowers & Cracraft

(57) ABSTRACT

A fuel injector includes an injector housing, a check control valve assembly within the injector housing, a direct-operated check, a valve biaser supported on the injector housing, and a dry-running protection valve trapped between the valve biaser and the injector housing. The dry-running protection valve limits expelling drained actuation fluid from the fuel injector to enable filling a low-pressure volume therein in advance of filling a low pressure drain line common to a plurality of fuel injectors in an internal combustion engine system.

20 Claims, 2 Drawing Sheets

(56) References Cited

U.S. PATENT DOCUMENTS

| | | | | |
|---|---|---|---|---|
| 6,981,655 | B1 * | 1/2006 | Mattes | F02M 47/027 239/102.1 |
| 7,270,114 | B2 | 9/2007 | Mattes et al. | |
| 7,278,593 | B2 | 10/2007 | Wang et al. | |
| 7,765,995 | B2 * | 8/2010 | Nakata | F02D 41/221 123/673 |
| 7,926,469 | B2 * | 4/2011 | Millet | F02M 45/12 123/509 |
| 9,482,165 | B2 | 11/2016 | Stockner et al. | |
| 9,638,422 | B2 | 5/2017 | Hall et al. | |
| 2005/0045150 | A1 | 3/2005 | Furukubo et al. | |
| 2006/0214033 | A1 * | 9/2006 | Koyanagi | F02M 61/168 239/585.1 |
| 2007/0057095 | A1 * | 3/2007 | Bayer | F16K 31/06 239/585.1 |
| 2007/0107699 | A1 * | 5/2007 | Fochtman | B23K 26/244 123/470 |
| 2008/0035114 | A1 | 2/2008 | Kawasumi | |
| 2008/0135020 | A1 * | 6/2008 | Hornby | F02M 21/0254 123/478 |
| 2010/0065020 | A1 | 3/2010 | Kubo et al. | |
| 2011/0297125 | A1 | 12/2011 | Shafer et al. | |
| 2013/0153686 | A1 | 6/2013 | Keeler | |
| 2020/0362805 | A1 | 11/2020 | Nair | |

FOREIGN PATENT DOCUMENTS

| | | | |
|---|---|---|---|
| GB | 2269426 | A | 9/1994 |
| JP | 2008045539 | A | 2/2008 |
| WO | 2015122537 | A1 | 8/2015 |

* cited by examiner

FUEL INJECTOR HAVING DRY-RUNNING PROTECTION VALVE AND FUEL SYSTEM USING SAME

TECHNICAL FIELD

The present disclosure relates generally to a fuel injector, and more particularly to a fuel injector and engine head assembly employing a dry-running protection valve.

BACKGROUND

Internal combustion engines are well-known and widely used in applications ranging from electrical power generation to providing torque for machinery propulsion, and powering pumps, compressors, and other equipment. In some internal combustion engines, such as compression-ignition diesel engines, the subsystem for providing fuel is complex and has many rapidly moving parts, dynamic and high fluid pressures, and otherwise harsh conditions. Service life of such fuel systems is typically desired to be in the tens of thousands of hours. In a typical fuel system for a compression-ignition diesel engine, a plurality of fuel injectors are each associated with one of a plurality of cylinders and extend into the individual cylinders to directly inject metered amounts of pressurized fuel. Individual fuel injectors may be equipped with so-called unit pumps having a fuel pressurization plunger driven by an engine cam or hydraulic fluid, for example. In other systems a common reservoir of pressurized fuel known as a common rail serves as a reservoir for storing a volume of fuel at a suitable injection pressure.

In either of these systems, some of the hydraulically actuated and electrically actuated components can be sensitive to fluid pressure phenomena generated elsewhere in the system, and/or sensitive to fluid damping or other phenomena within individual injectors. One known common rail fuel system, for instance, is disclosed in United States Patent Application No. 2011/0297125 to Shafer et al.

SUMMARY OF THE INVENTION

In one aspect, a fuel injector includes an injector housing defining a longitudinal axis and having formed therein an actuation fluid inlet and an actuation fluid outlet, and a nozzle having formed therein a nozzle supply passage and a plurality of spray outlets. A check control valve assembly is within the injector housing. The fuel injector further includes a direct-operated check movable between a closed position blocking the plurality of spray outlets from the nozzle supply passage, and an open position, and a valve biaser supported on the injector housing. The fuel injector further includes a dry-running protection valve trapped between the valve biaser and the injector housing and movable, in opposition to a biasing force of the valve biaser, from a closed position blocking the actuation fluid outlet to an open position.

In another aspect, an engine head assembly includes an engine head having an injector bore formed therein, and a fuel injector within the injector bore and including an injector housing. The injector housing defines a longitudinal axis and has formed therein an actuation fluid inlet and an actuation fluid outlet, and includes a nozzle having formed therein a nozzle supply passage and a plurality of spray outlets. A check control valve assembly is within the injector housing, and a direct-operated check is movable between a closed position blocking the plurality of spray outlets from the nozzle supply passage, and an open position. A valve biaser is within the injector bore, and a dry-running protection valve is trapped between the valve biaser and the injector housing and movable, in opposition to a biasing force of the valve biaser, from a closed position blocking the actuation fluid outlet to an open position.

In still another aspect, a method of operating a fuel system for an engine includes operating check control valve assemblies in each of a plurality of fuel injectors in the fuel system to open and close outlet checks in the plurality of fuel injectors. The method further includes draining actuation fluid from check control chambers in the plurality of fuel injectors based on the operation of the check control valve assemblies, and limiting expelling the drained actuation fluid from the plurality of fuel injectors with dry-running protection valves of each of the plurality of fuel injectors. The method still further includes filling low-pressure volumes in each of the plurality of fuel injectors with the drained actuation fluid in advance of filling a low pressure return conduit common to the plurality of fuel injectors, based on the limiting of the expelling of the drained actuation fluid.

DETAILED DESCRIPTION

Figure 1:
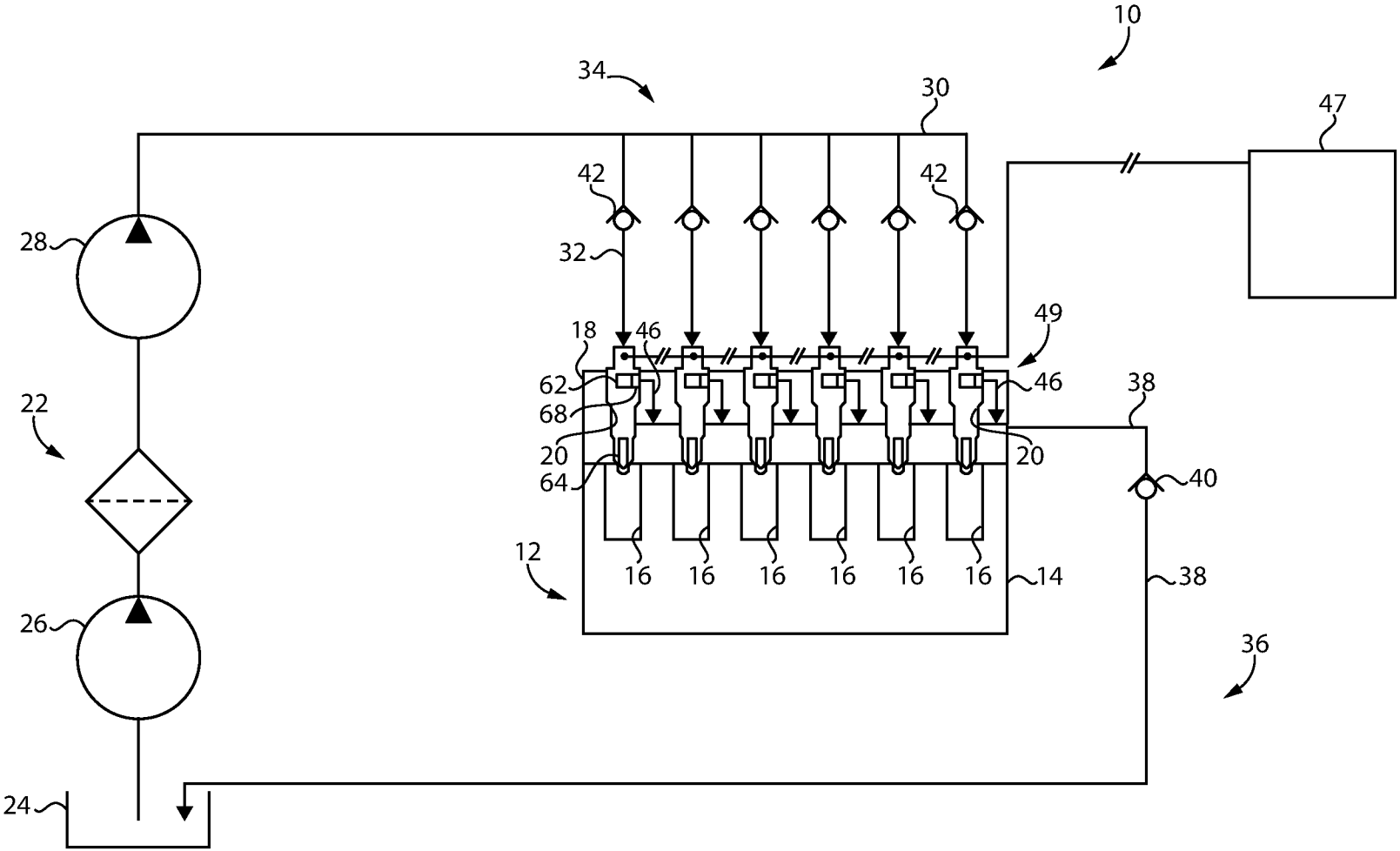
FIG. 1 is a diagrammatic view of an internal combustion engine system, according to one embodiment.

Referring to FIG. 1, there is shown an internal combustion engine system 10, according to one embodiment. Internal combustion engine system 10 includes an engine 12 having a cylinder block 14 with a plurality of combustion cylinders 16 formed therein. Combustion cylinders 16 may include any number of cylinders in any suitable arrangement, such as a V-pattern, an inline pattern, or still another. An engine head 18 is positioned upon cylinder block 14 and forms part of an engine head assembly 49. Internal combustion engine system 10 further includes a fuel system 22 having a high pressure side 34 and a low pressure side 36. Fuel system 22 also includes a fuel tank 24, a low pressure transfer pump 26, a high pressure pump 28, and a pressurized fuel reservoir 30.

A plurality of fuel feed lines 32 extend from pressurized fuel reservoir 30 into engine head 18 and may be, or may include, so called quill connectors in some embodiments. A low pressure return line or conduit 38 may be formed in part within engine head 18 and extends from engine head 18 back to fuel tank 24 in the illustrated embodiment. A plurality of check valves 42 may be positioned fluidly between pressurized fuel reservoir 30 and engine head 18, and another check valve 40 may be positioned fluidly between engine head 18 and fuel tank 24. Internal combustion engine 12 may include a compression-ignition internal combustion engine structured to operate on a suitable compression-ignition liquid fuel, such as a diesel distillate fuel, however, the present disclosure is not thereby limited and other suitable fuel types and ignition strategies might be used. Although not specifically illustrated in FIG. 1, engine 12 will be equipped with a plurality of pistons each movable within one of combustion cylinders 16 between a top dead center position and a bottom dead center position to compress a mixture of intake air, or intake air and other gases such as recirculated exhaust gas and/or a gaseous fuel in a dual fuel application, to an autoignition threshold. Autoignition and combustion drives the subject pistons to rotate a crankshaft in a generally conventional manner for providing torque to propel a vehicle, produce electrical power, or rotate parts in another type of machinery such as a pump, a compressor, or still others.

Engine head 18 may have an injector bore 20 formed therein, typically a plurality of injector bores each associated with one of combustion cylinders 16. Fuel system 22 further includes a plurality of fuel injectors 44 each positioned within, meaning at least partially within, one of injector bores 20. Fuel injectors 44 may be supported in engine head 18 for direct injection, such that each extends partially into or is otherwise in fluid communication with one of combustion cylinders 16. As discussed above, in the illustrated embodiment fuel injectors 44 are supplied with pressurized fuel from pressurized fuel reservoir 30. Pressurized fuel reservoir 30 may be maintained at a desired fuel injection pressure. In other embodiments unit pumps, multiple pressurized fuel reservoirs each associated with a plurality, but less than all, of fuel injectors 44 might be used. An electronic control unit 47 is provided for monitoring and operating various of the components of fuel system 22, including fuel injectors 44.

Figure 2:
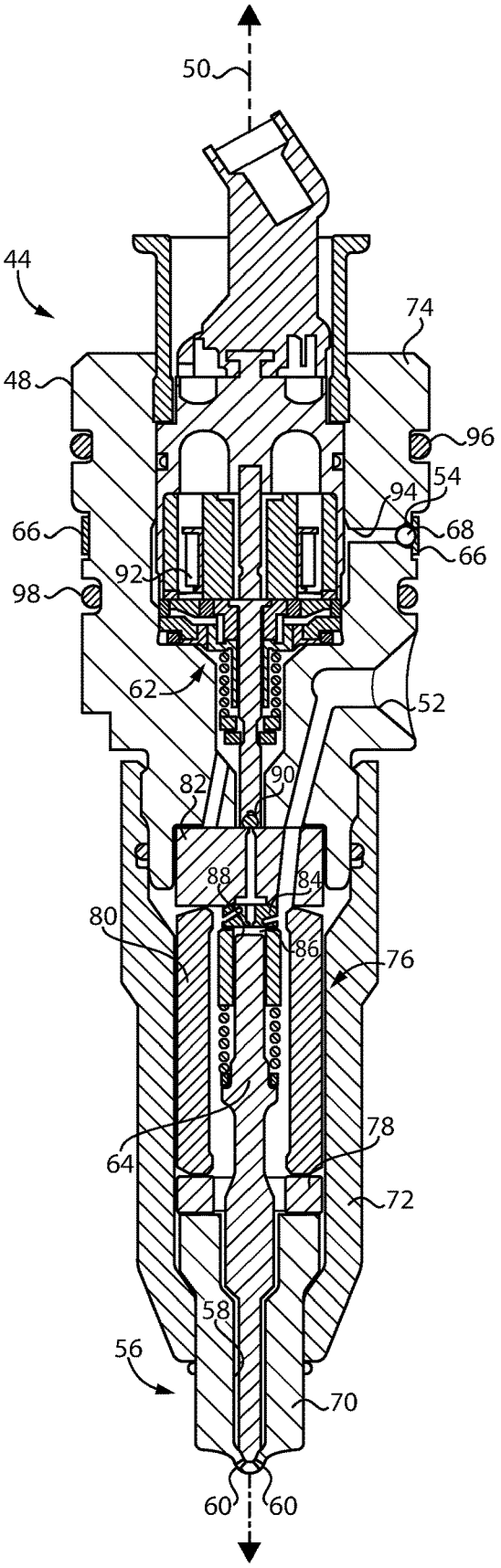
FIG. 2 is a sectioned side diagrammatic view of a fuel injector, according to one embodiment.

Referring also now to FIG. 2, there is shown one of fuel injectors 44 in further detail. Each of the plurality of fuel injectors 44, hereinafter referred to in the singular at times, includes an injector housing 48 defining a longitudinal axis 50 and having formed therein an actuation fluid inlet and an actuation fluid outlet 44. Each injector housing 48 further includes a nozzle 56 having formed therein a nozzle supply passage 58 and a plurality of spray outlets 60. Fuel injector 44 further includes a check control valve assembly 62 within, meaning at least partially within, injector housing 48. A direct-operated check 64 of fuel injector 44 is movable between a closed position blocking spray outlets 60 from nozzle supply passage 58, and an open position where direct-operated check 64 does not block spray outlets 60 from nozzle supply passage 58. Fuel injector 44 further includes a valve biaser 66 supported on injector housing 48, and a dry-running protection valve 68 trapped between valve biaser 66 and injector housing 48 and movable, in opposition to a biasing force of valve biaser 66, from a closed position blocking actuation fluid outlet 54 to an open position where dry-running protection valve 68 does not block actuation fluid outlet 54.

Additional features of fuel injector 44 shown in FIG. 2 include a tip piece 70, forming a part of nozzle supply passage 58, and having spray outlets 60 formed therein. Tip piece 70 is received within a case 72 that is attached, such as by a threaded connection, to an injector body 74 having actuation fluid inlet 52 and actuation fluid outlet 54 formed therein. Certain components in fuel injector 44 may be clamped together to provide desired fluid connections and fluid seals between and amongst the various components, and together forming a stack 76. Stack 76 can include a first stack piece 78 in contact with tip piece 70, itself a part of stack 76, a second stack piece 80, and a valve seat plate 82. An orifice piece or plate 84 may be disposed between valve seat plate 82 and direct-operated check 64. A check control chamber 86 is formed in fuel injector 44 between orifice plate 84 and direct-operated check 64. Direct-operated check 64 includes a closing hydraulic surface 88 exposed to a fluid pressure of check control chamber 86.

Check control valve assembly 62 may include a control valve 90 movable between a closed position, blocking check control chamber 86 from actuation fluid outlet 54, and an open position where check control chamber 86 is fluidly connected to actuation fluid outlet 54. Check control valve assembly 62 further includes an electrical actuator 92, such as an electrical solenoid actuator, that can be energized by way of electronic control unit 47 to enable control valve 90 to move between its closed position and open position according to well-known principles. Control valve 90 might include a flat-sided ball valve, or spherical ball valve, and be free-floating in the sense it is not directly attached to an armature. Control valve 90 might also be a disc, a valve directly attached to an armature, or a variety of other known control valve types or configurations. Valve seat plate 82 forms a valve seat (not numbered) contacted by control valve 90 at its closed position. In some embodiments valve seat plate 82 and orifice plate 84 could be integrated into a single component. The various fluid connections and passages and orifices formed by valve seat plate 82 and orifice piece 84 enable control chamber 88 to be rapidly reduced in fluid pressure, and rapidly replenished in fluid pressure, based on operation of control valve assembly 62, again according to well-known principles.

Actuation fluid inlet 52 may be a pressurized fuel inlet directly fluidly connected to nozzle supply passage 58, such that pressurized fuel is continuously or substantially continuously present in nozzle supply passage 58 and available for injection whenever direct-operated check 64 is opened. In other embodiments, fuel pressurization could take place such as by way of a cam-actuated or a hydraulically actuated fuel pressurization plunger within fuel injector 44 or associated therewith. Fuel injector 44 is thus a single-fluid injector where fuel is not only injected but also used as an actuation fluid. In other embodiments, an actuation fluid such as fuel, oil, or another hydraulic fluid, could be delivered in a hydraulic circuit separate from the fuel injection delivery.

As also shown in FIG. 1, a plurality of drain lines 46, formed in engine head 18, each extend from one of fuel injectors 44 to low pressure return conduit 38. Each fuel injector 44 may be equipped with a dry-running protection valve 68 as described above, such that a first dry-running protection valve 68 associated with a first fuel injector 44 within a first injector bore 20 and a second dry-running protection valve 68 of a second fuel injector 44 within a second injector bore 20 are fluidly between common fuel return conduit 38 and the respective first fuel injector 44 or second fuel injector 44. As noted above, engine 12 can include any number of combustion cylinders 16, and thus can include associated fuel injectors for each combustion cylinder 16. Fuel system 22 might include 6, 8, 10, 16, or even 20 or more fuel injectors, for instance, each having a dry-running protection valve and a drain line positioned fluidly between the respective fuel injector and a common fuel return conduit. As a result, there can be considerable volume of fuel system 22 within low pressure side 36. During operating internal combustion engine system 10, and particularly during starting, some or all of the fuel volume in low pressure side 36 may be drained of fuel. As fuel injectors 44 begin to operate the check control valve assemblies 62 will begin to drain fuel past the respective control valves 90 towards the respective actuation fluid outlets 54. Absent a mitigation strategy, as further discussed herein, the considerable volume in low pressure side 36 would need to be filled or substantially filled with expelled fuel before fuel would begin to fill passages and voids within the respective fuel injectors 44 between the respective control valves 90 and actuation fluid outlets 54.

It has been observed that some fuel within a fuel injector can provide desirable damping effects on the motion and operation of control valves, and fuel injectors may be designed, operated, and calibrated with such damping in mind. "Dry-running" can be understood as operation of a fuel injector where a low pressure volume 94 as shown in FIG. 2 would be empty or insufficiently filled with fuel, presenting various operating problems such as errors in injection timing, amount, or rate shape, and/or creating wear problems for instance. Dry-running protection valves 68 in each of fuel injectors 44 assist in filling low pressure volume 94 in advance of filling low pressure fuel return conduit 38 or other cavities and/or conduits in low pressure side 36 of fuel system 22.

Figure 3:
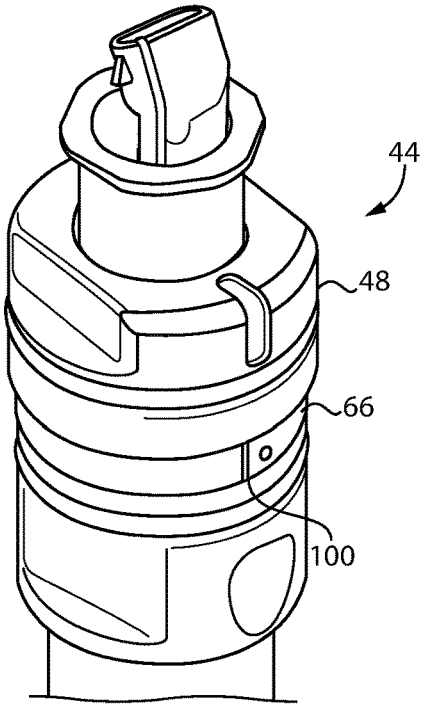
FIG. 3 is a diagrammatic view, in perspective, of a portion of the fuel injector of FIG. 2.
Figure 4:
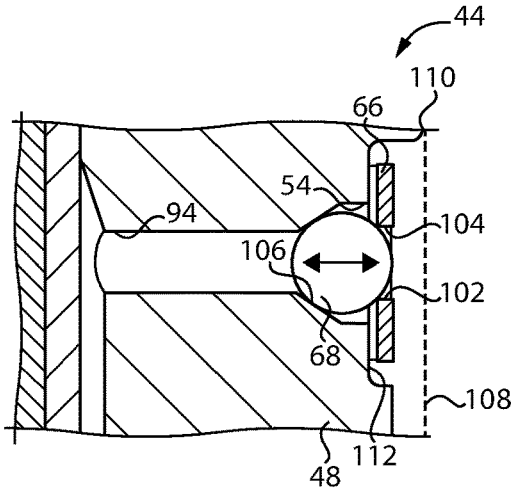
FIG. 4 is a sectioned side diagrammatic view of a portion of the fuel injector as in FIG. 2.

As noted above, fuel injector 44 includes a valve biaser 66 supported on injector housing 48 and interacting with dry-running protection valve 68. Referring also now to FIGS. 3 and 4, valve biaser 66 may include a spring band at least partially circumferential of injector housing 48. Configured as a spring band, valve biaser 66 may be formed from a single piece of a suitable substantially cylindrical material such as a steel or other suitably elastically deformable metallic material. Valve biaser 66 may thus be supported on injector housing 48 in a slip-fit or mild interference fit fashion, but could be attached with fasteners, with an additional retention or mounting piece itself directly attached to injector housing 48, or supported on injector housing 48 by way of any other suitable strategy. Valve biaser 66 maintains dry-running protection valve 68 generally in a desired travel path radially outward-radially inward relative to longitudinal axis 50, such that dry-running protection valve 68 can open in response to fluid pressure in low pressure volume 94, and close with the assistance of a biasing force of valve biaser 66 to block low pressure volume 94, when fluid pressure in low pressure volume 94 is low, or where cross-talk pressure pulses are produced elsewhere in fuel system 22. Such functionality enables drained actuating fluid to build up in low pressure volume 94 instead of draining on downstream.

Configured as a spring band, valve biaser 66 may also be fully circumferential of injector housing 48 and has a relief split 100 formed therein. Relief split 100 can be a complete split axially through valve biaser 66, or one or more partial splits or openings. In the illustrated embodiment injector housing 48 forms an outside groove 112 extending circumferentially around longitudinal axis 50, and valve baiser 66 is within outside groove 112. Injector housing 48 may also include a wet seat 106 that forms actuation fluid outlet 54. Wet seat 106 may be contacted by dry-running protection valve 68 at the closed position. Valve biaser 66 may also include a dry seat 102, with dry-running protection valve 68 being in contact with dry seat 102 at each of the closed position and the open position of dry-running protection valve 68. From FIG. 4 it will be readily understood that dry-running protection valve 68 moves, generally left-right as shown by the arrow in the illustration, to open wet seat 106 and permit expelling of drained actuation fluid. Support and positioning of dry-running protection valve 68 by way of dry seat 102 can assist in retaining dry-running protection valve 68 in a desired position relative to injector housing 48. It can also be noted from FIG. 4 that dry seat 102 may be formed by a hole 104 extending radially through valve biaser 66, although the present disclosure is not thereby limited.

As still further illustrated in FIG. 4 it can be seen that outside groove 112 is formed radially inward of an outside surface 110 of injector housing 48. Outside surface 110 may define an injector boundary 108. Injector boundary 108 can be understood as the radially outward, cylindrical spatial envelope formed by injector housing 48, which corresponds generally to and is typically just slightly smaller than a size of injector bore 20. Dry-running protection valve 68 and valve biaser 66 may be within injector boundary 108 at both the closed position and the open position of dry-running protection valve 68. This arrangement generally enables fuel injector 44 to be installed in an injector bore in an engine head without modification of the engine head and without concern of interference between dry-running protection valve 68 and/or valve biaser 66 with inside surfaces of the engine head forming the injector bore. As can also be seen from FIG. 2, engine head assembly 49 further includes a first fuel seal 96 between injector housing 48 and engine head 18 within injector bore 20, and a second fuel seal 98 between injector housing 48 and engine head 18 within injector bore 20. First fuel seal 96 is positioned upon a first axial side of actuation fluid outlet 54, and second fuel seal 98 is positioned upon a second axial side of actuation fluid outlet 54.

INDUSTRIAL APPLICABILITY

Referring to the drawings generally, operating fuel system 22 can include operating check control valve assemblies 62 in each of fuel injectors 44 in fuel system 22 to open and close outlet checks 64 in fuel injectors 44. Actuation fluid may be drained from check control chambers 86 in the fuel injectors 44, such as to low pressure volumes 94. Dry-running protection valves 68 of each of fuel injectors 44 are biased closed and thus operate to limit expelling drained actuating fluid from fuel injectors 44. As suggested above, low pressure volumes 94 in each of fuel injectors 44 can be filled, meaning at least partially filled, with the drained actuating fluid in advance of filling low pressure return conduit 38, common to the plurality of fuel injectors 44.

As low pressure volumes 94 are filled, dry-running protection valves 68 an be urged open based on continued operation of control valve assemblies 62, to commence or complete filling low pressure return conduit 38. In the illustrated embodiment, each dry-running protection valve 68 includes a ball valve, biased towards its closed position by valve biaser 66. In other instances, a different valve type such as a flat valve, a valve integrated with and formed as a single piece with a valve biaser, a slide-type hydraulic valve, or still other valve configurations may be used. Embodiments are also contemplated where multiple dry-running protection valves are used with each fuel injector and associated with each of a plurality of actuation fluid outlets. As discussed above, valve biaser 66 may be a spring band. In other instances, a coil spring, a leaf spring, or any other suitable elastically deformable device capable of producing a biasing force to bias a dry-running protection valve as contemplated herein might be used.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

an injector housing defining a longitudinal axis and having formed therein an actuation fluid inlet and an actuation fluid outlet, and including a nozzle having formed therein a nozzle supply passage and a plurality of spray outlets;

a check control valve assembly within the injector housing;

a direct-operated check movable between a closed position blocking the plurality of spray outlets from the nozzle supply passage, and an open position;

a valve biaser supported outside of the injector housing on an outer surface of the injector housing having the actuation fluid outlet formed therein;

a dry-running protection valve trapped between the valve biaser and the injector housing and movable, in opposition to a biasing force of the valve biaser, from a closed position blocking the actuation fluid outlet to an open position; and a check control chamber is formed in the injector housing, and the check control valve assembly includes a check control valve fluidly between the check control chamber and the actuation fluid outlet.

2. The fuel injector of claim 1 wherein:

the actuation fluid inlet is a pressurized fuel inlet fluidly connected to the nozzle supply passage;

a check control chamber is formed in the fuel injector, and the direct-operated check includes a closing hydraulic surface exposed to the check control chamber; and the check control valve assembly includes a control valve movable between a closed position, blocking the check control chamber from the actuation fluid outlet, and an open position.

3. The fuel injector of claim 1 wherein the valve biaser includes a spring band at least partially circumferential of the injector housing.

4. The fuel injector of claim 3 wherein the spring band is fully circumferential of the injector housing and has a relief split formed therein.

5. The fuel injector of claim 3 wherein the injector housing includes a wet seat forming the actuation fluid outlet and contacted by the dry-running protection valve at the closed position.

6. The fuel injector of claim 5 wherein the valve biaser includes a dry seat, and the dry-running protection valve is in contact with the dry seat at each of the closed position and the open position.

7. The fuel injector of claim 3 wherein the dry-running protection valve includes a ball valve.

8. The fuel injector of claim 1 wherein the injector housing forms an outside groove extending circumferentially around the longitudinal axis, and the valve biaser is within the outside groove.

9. The fuel injector of claim 8 wherein:

the injector housing includes an outside housing surface defining an injector boundary; and the outside groove is formed radially inward of the outside housing surface and the valve biaser is within the injector boundary at each of the closed position and the open position of the dry-running protection valve.

10. An engine head assembly comprising:

an engine head having an injector bore formed therein;

a fuel injector within the injector bore and including an injector housing defining a longitudinal axis and having formed therein an actuation fluid inlet and an actuation fluid outlet, and including a nozzle having formed therein a nozzle supply passage and a plurality of spray outlets;

a check control valve assembly within the injector housing;

a direct-operated check movable between a closed position blocking the plurality of spray outlets from the nozzle supply passage, and an open position;

a valve biaser within the injector bore, the valve biaser being located outside of the injector housing between the injector housing and the engine head and supported on an outer surface of the injector housing exposed to the injector bore and having the actuation fluid outlet formed therein; and a dry-running protection valve trapped between the valve biaser and the injector housing and movable, in opposition to a biasing force of the valve biaser, from a closed position blocking the actuation fluid outlet to an open position.

11. The engine head assembly of claim 10 wherein:

the injector housing forms an outside groove extending circumferentially around the longitudinal axis, and the valve biaser is within the outside groove; and the injector housing includes an outside housing surface defining an injector boundary, and the outside groove is formed radially inward of the outside housing surface and the valve biaser is within the injector boundary at each of the closed position and the open position of the dry-running protection valve.

12. The engine head assembly of claim 10 wherein the valve biaser includes a spring band.

13. The engine head assembly of claim 12 wherein the dry-running protection valve includes a ball valve.

14. The engine head assembly of claim 13 wherein the spring band has a relief split formed therein.

15. The engine head assembly of claim 12 wherein the spring band is circumferential of the injector housing and supported on the injector housing.

16. The engine head assembly of claim 10 further comprising:

a first fuel seal between the injector housing and the engine head within the injector bore and positioned upon a first axial side of the actuation fluid outlet; and a second fuel seal between the injector housing and the engine head within the injector bore and positioned upon a second axial side of the actuation fluid outlet.

17. The engine head assembly of claim 10 wherein the engine head has a second injector bore formed therein, and further comprising a second fuel injector having a second dry-running protection valve and a second valve biaser, and a fuel return conduit, and wherein each of the first dry-running protection valve and the second dry-running protection valve is fluidly between the fuel return conduit and the respective first fuel injector or second fuel injector.

18. A method of operating a fuel system for an engine comprising:

operating check control valve assemblies in each of a plurality of fuel injectors in the fuel system to open and close outlet checks in the plurality of fuel injectors;

draining actuation fluid from check control chambers in the plurality of fuel injectors based on the operation of the check control valve assemblies;

limiting expelling the drained actuation fluid through an actuation fluid outlet in each respective one of the plurality of fuel injectors with dry-running protection valves of each of the plurality of fuel injectors;

filling low-pressure volumes in each of the plurality of fuel injectors with the drained actuation fluid in advance of filling a low pressure return conduit common to the plurality of fuel injectors, based on the limiting of the expelling of the drained actuation fluid;

expelling actuation fluid through the actuation fluid outlets, based on operation of the check control valve assemblies, after the filling of the low-pressure volumes in each of the plurality of fuel injectors; and the expelling actuation fluid in each respective fuel injector further including expelling the actuation fluid in opposition to a bias of a valve biaser within an injector bore between an outer surface of an injector housing and an engine head.

19. The method of claim 18 wherein the actuation fluid is pressurized fuel.

20. The method of claim 19 wherein the limiting of the expelling of the drained actuation fluid includes limiting expelling the drained actuation fluid with dry-running protection valves each including a ball valve biased toward a closed position blocking an actuation fluid outlet with a spring band supported on the respective fuel injector.

* * * * *